US005556302A

United States Patent [19]

Taniuchi et al.

[11] Patent Number: 5,556,302

[45] Date of Patent: Sep. 17, 1996

[54] ELECTRICAL CONNECTOR

[75] Inventors: Osamu Taniuchi; Hisashi Konoya; Youichi Nankoh, all of Yokkaichi, Japan

[73] Assignee: Sumitomo Wiring Systems, Ltd., Japan

[21] Appl. No.: 386,910

[22] Filed: Feb. 8, 1995

[30] Foreign Application Priority Data

Feb. 8, 1994 [JP] Japan ..... 6-036443

[51] Int. Cl.[6] ..... H01R 13/60

[52] U.S. Cl. ..... 439/533; 439/372; 439/310

[58] Field of Search ..... 439/345, 350, 439/372, 352, 310, 533

[56] References Cited

U.S. PATENT DOCUMENTS 4,884,978 12/1989 Inaba et al. ..... 493/372 X 4,892,490 1/1990 Tsuchiya et al. ..... 439/533

4,938,710 7/1990 Aihara et al. ..... 439/533 X 5,376,017 12/1994 Taniuchi et al. ..... 439/372

*Primary Examiner*—Khiem Nguyen

*Attorney, Agent, or Firm*—Banner & Allegretti, Ltd.

[57] ABSTRACT

An electrical connector assembly is provided which assumes a fully coupled state even if it was in a semi-coupled state prior to being attached to a support bracket (B). A lever has an inclined coupling surface which draws a semi-coupled female connector housing in the coupling direction, thereby ensuring a fully coupled state. A support bracket (B) cannot be fully inserted until the lever has moved the connectors from a semi-coupled to a fully coupled condition. If the connectors are improperly connected a second inclined surface of the lever decouples the connectors as the support bracket (B) is engaged.

18 Claims, 5 Drawing Sheets

ELECTRICAL CONNECTOR

BACKGROUND OF THE INVENTION

The present invention relates to an electrical connector equipped with a lever.

As regards connectors which require a substantial mating force, for example when it is desired to mate male and female connectors with 20 contacts or more, connectors are known which have been provided with a lever in order to obtain the substantial mating force.

In a conventional connector provided with a lever, the lever is provided with freedom to turn on the outer wall of a male housing provided with a hood. When the female housing is inserted inside the hood and the lever is turned, an engagement part provided on the lever engages with the female housing, thereby urging the female housing in the coupling direction, and bringing the male and the female connector housings into a fully coupled state. Such a conventional connector provided with a lever requires two operations, that of inserting the female connector housing into the hood to achieve the semi-coupled state, and that of operating the lever to draw the connectors together. It occasionally happens that the operator forgets to turn the lever when coupling the male and the female connector housings, and on such occasions the male and the female connector housings may remain in the semi-coupled state.

Japanese Patent Kokai Hei 1-92781 discloses an invention in which such a semi-coupled state is detected in a connector provided with a lever. In this document, a turning piece, acting as a detector on the side which makes contact with an attachment surface when the connector is attached to an attachment bracket, is provided with freedom to turn on one of the connector housings. This turning piece is turned by the attachment surface to the position following the side surface of the other connector housing when the connector is in the fully coupled state, being attached in such a way as not to impede the attachment of the connector, and an engagement projection formed at its end engages with a lock piece provided on one of the connector housings, in such a way that the two connector housings are mated. The construction is such that, in the semi-coupled state, the turning piece comes into contact with the side surface of the other connector housing and is impeded from turning, and it is therefore not able to turn as far as the position following the side surface of the other connector housing described above. Thus, it is arranged in such a way that the connector can be attached to the attachment bracket only in the fully coupled state, and the semi-coupled state can be detected.

However, in such a conventional connector in which the semi-coupled state is detected, the semi-coupled state is first discovered on attempting the operation of attaching the connector to the object to which it is to be attached, and the coupling operation has to be carried out again.

Furthermore, because the configuration is such that the detector (turning piece) which detects the semi-coupled state makes the detection by coming into contact with the attachment surface of the object to which the connector is to be attached, the connector has only been able to be attached to a site having such an attachment surface.

The present invention has taken the above-mentioned problems into account, and comprises a connector provided with a lever, which can ensure a fully coupled state even if the connector is in the semi-coupled state when it is being attached to the object to which it is to be attached, and which can even be attached in sites which do not have such attachment surfaces.

SUMMARY OF THE INVENTION

According to the invention there is provided a connector assembly for attachment to a support member provided on an object to which the connector assembly is to be fixed in use, the connector assembly comprising a male connector and a female connector each having a free end for mutual engagement along an assembly axis, one of said connectors having a lever pivoted thereon and the other of said connectors having a lever receiving aperture and a lever abutment, said lever being engageable in said aperture with said lever abutment and being pivotable in use from an open position to a closed position flush with the outer surface of said one connector thereby urging the male and female connector into a fully coupled state wherein said one connector includes a support receiving member for engagement with said support member, the support receiving member being adapted to ensure movement of said lever to said closed position on full engagement with said support member.

Preferably the male connector has a hood to receive the female connector, and said lever is pivoted on the hood.

In such a construction, having coupled the female and male connector housings, the lever is turned to the position in which it is flush with the outer surface of the hood, a part of the lever which fits into the hood pushes the other connector housing in the coupling direction, thereby bringing the female and male terminal pieces into a fully coupled state. The support receiving member engages with the support member, and the connector assembly is thus attached to the substructure.

Alternatively if an attempt is made to attach the connector to the support member in the semi-coupled state (without the lever lying in the flush position), then the support member engages with the upstanding lever which consequently pivots to the flush position. As a result, the lever pushes the other connector housing in the coupling direction, thereby bringing the connector housings into the fully coupled state.

The invention has the advantage that, even if the operator omits to carry out the operation of pivoting the lever, this will be corrected and the connector will be put into the fully coupled state when it is attached to the support member; the connector assembly is therefore prevented from being attached to the support member in a semi-coupled state.

In a preferred embodiment the lever is provided with an inclined coupling surface which makes contact with the lever abutment and thereby guides the other connector housing in the coupling direction.

In use the lever pivots to the position in which it lies flush, and in doing so the inclined coupling surface engages the lever abutment so that the other connector housing is smoothly pushed in the coupling direction.

Preferably the lever is provided also with an inclined disengagement surface which guides the other connector in the disengagement direction if the connectors are in less than the semi-coupled state.

In this latter case the connector housings are in an even more improperly coupled state than the semi-coupled state, and the lever disengagement surface pushes the other connector housing in the disengagement direction to ensure that the connectors are fully disengaged.

This has the advantage that, in addition to the correction of the semi-coupled state, the improperly coupled state is detected and the assembly assumes a condition which can clearly be visually checked, the connectors having been pushed apart.

Other features of the invention will be apparent from the following description of a preferred embodiment shown by way of example only in the accompanying drawings, in which:

DESCRIPTION OF THE PREFERRED EMBODIMENT

Figure 1:
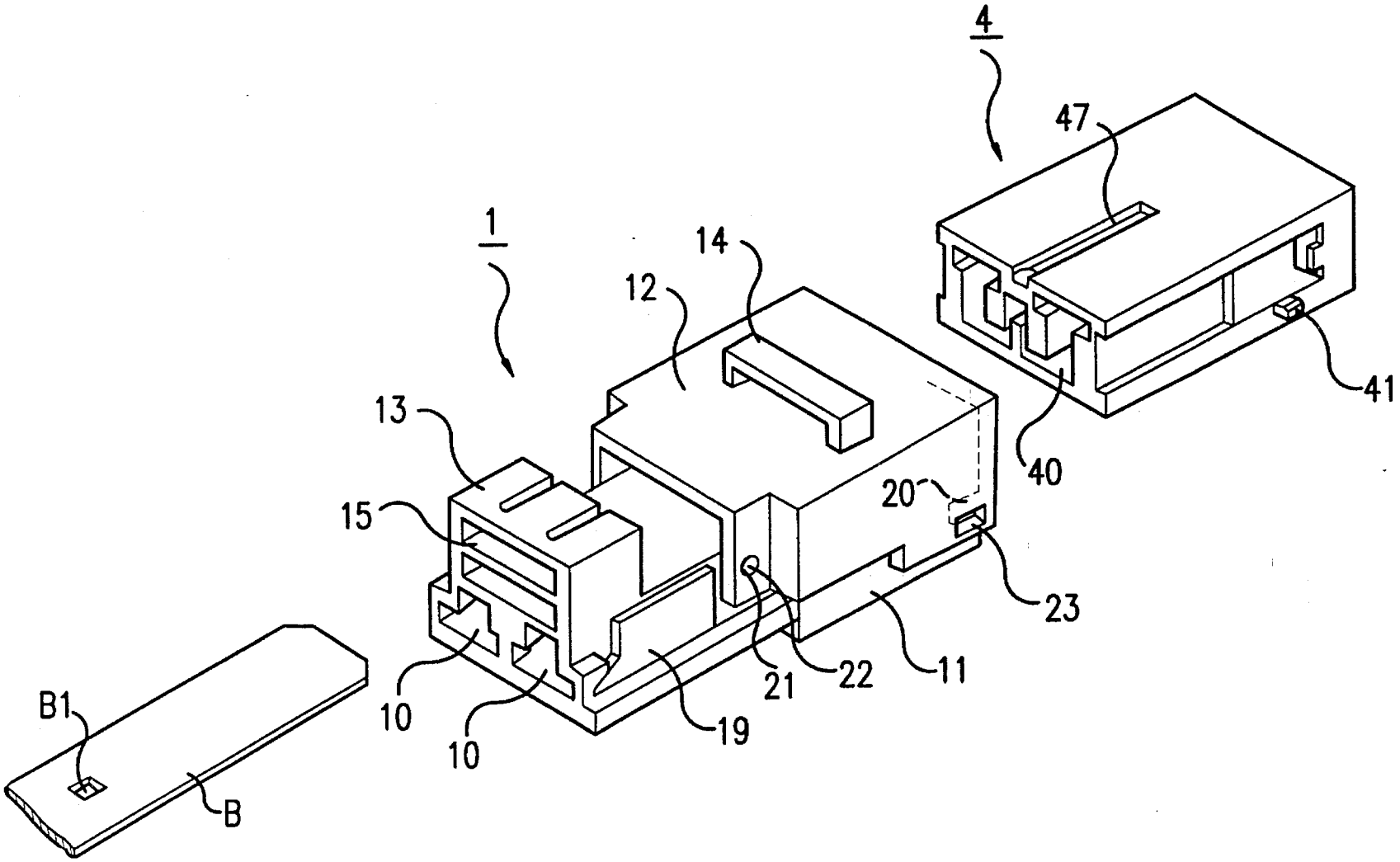
FIG. 1 is an isometric view of a connector assembly according to the invention in the separated state.

As shown in FIG. 1, the connector assembly is attached by insertion onto a tongue-shaped attachment bracket B provided projecting from the object onto which the connector is to be fixed. The connector itself comprises a female connector housing 4 and a male connector housing 1.

Male terminal receiving chambers 10 housing male terminals 2 are provided in parallel to the left and to the right in the male connector housing 1. The male connector housing 1 is also provided on its coupling side with a hood 11 which couples with the female connector housing 4. A lever 12 is provided with freedom to pivot relative to the top surface of the male connector housing 1 and covering the top surface of the hood 11. A bracket attachment part 13, by means of which the male connector housing 1 engages with the attachment bracket B of the object to which the connector is to be attached, is also formed in the top surface of the male connector housing 1; a bracket stop 14 is formed in the top surface of the lever 12 as illustrated.

Figure 2:
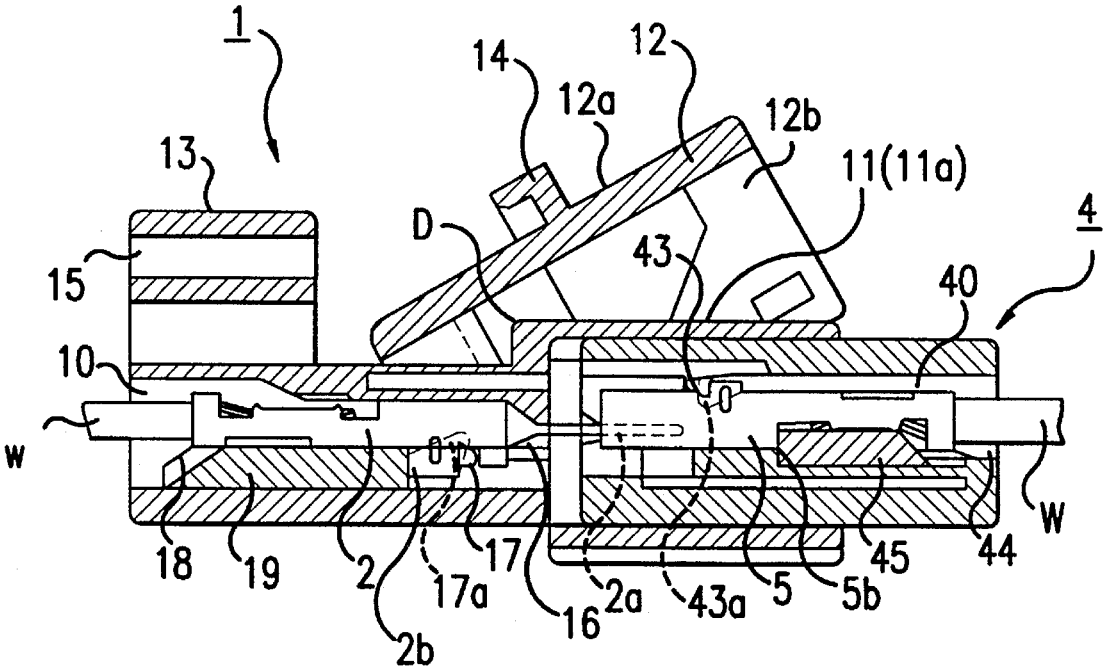
FIG. 2 is a longitudinal cross section of the connector assembly in the semi-coupled state.
Figure 3:
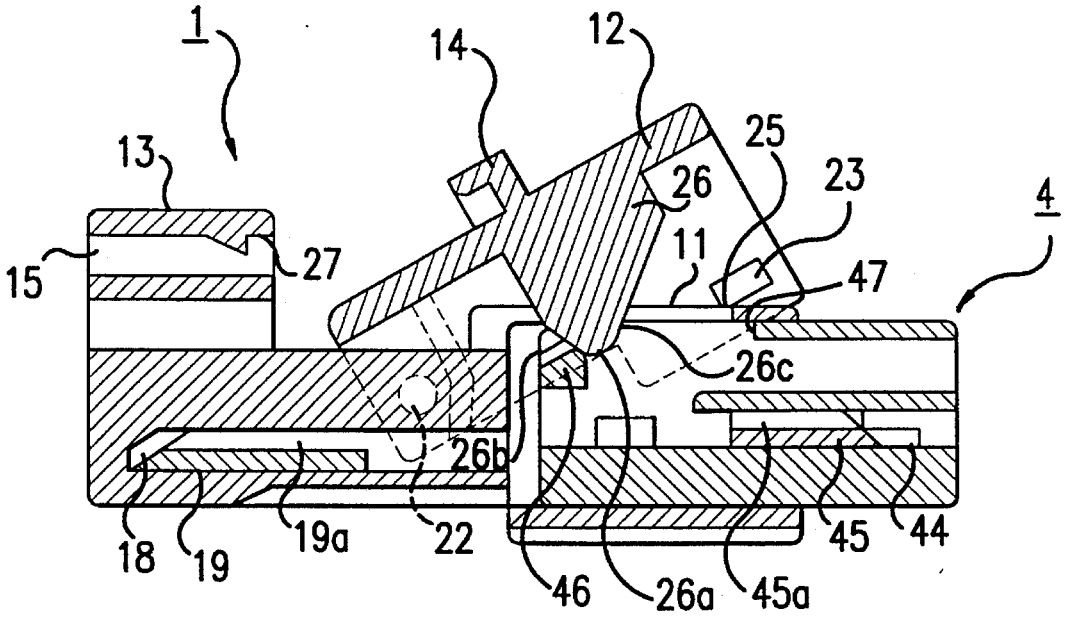
FIG. 3 is a longitudinal cross section in the semi-coupled state showing the pushing member.

As shown in FIGS. 2 and 3, a male terminal 2 with an electrical wire W attached at its rear is inserted in the male terminal receiving chamber 10, at the front end of which is formed a passage hole 16 from which a tab 2*a* at the front of the male terminal 2 projects into the hood 11. An upwardly directed flexible lance 17 is formed extending forwards from the bottom surface in the centre of the male terminal receiving chamber 10. A holding projection 17*a* is formed on the upper surface at the front of the lance 17, and engages a holding hole formed in the male terminal 2, thereby effecting a first hold on the male terminal 2. A retainer insertion hole 18, which receives a retainer 19 is formed in the side surface of the male connector housing 1 running through to the terminal receiving chamber 10. The retainer 19 has a raised track 19*a* projecting from the top surface thereof and which engages with a stabiliser 2*b* provided in the bottom surface of the male terminal 2, thereby effecting a second hold on the male terminal 2.

A step D is provided to the rear of the hood 11, being such that the rear end of a lever 12 discussed hereinbelow is able to freely pivot on the male connector, and an in-fitting hole 25 through which a pushing piece 26 discussed hereinbelow enters and exits is provided extending in the front-to-back direction in the top surface of the hood 11. Furthermore, notches 20, through which pass engagement projections 41 provided on the side surfaces of the female connector housing 4 discussed hereinbelow, are formed on the outer surface of the hood 11 (see FIG. 1). The lever 12 is pivotable on the hood 11 between parting and touching conditions described below in greater detail.

Figure 4:
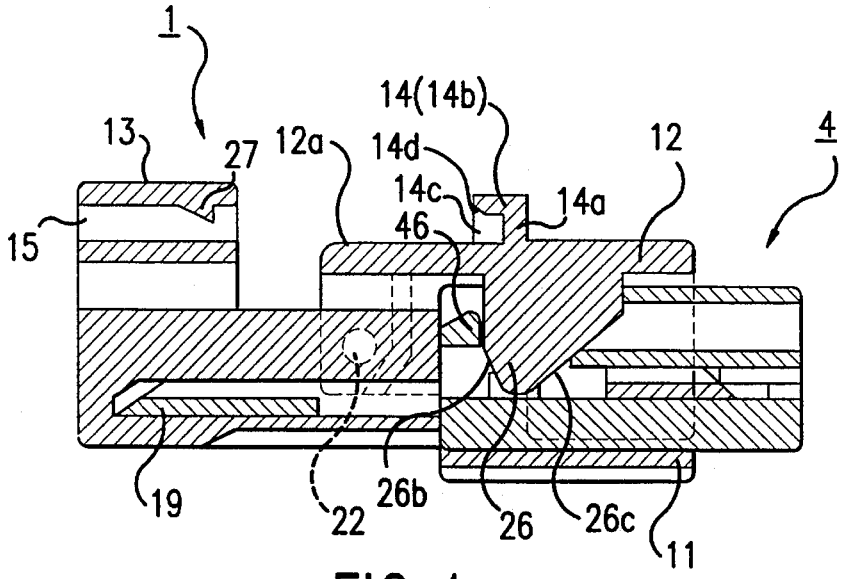
FIG. 4 is the cross section of FIG. 3 in the fully coupled state.
Figure 5:
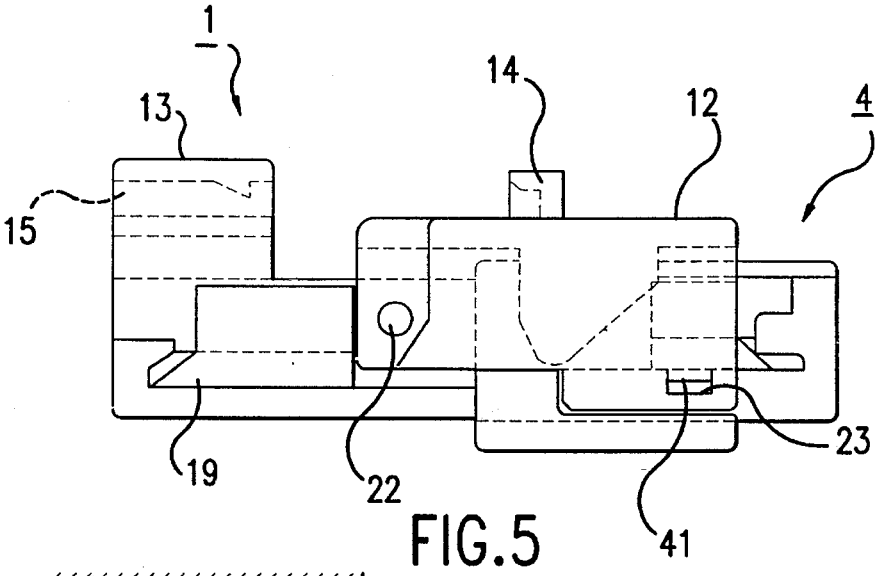
FIG. 5 is a side elevation in the fully coupled state.
Figure 6:
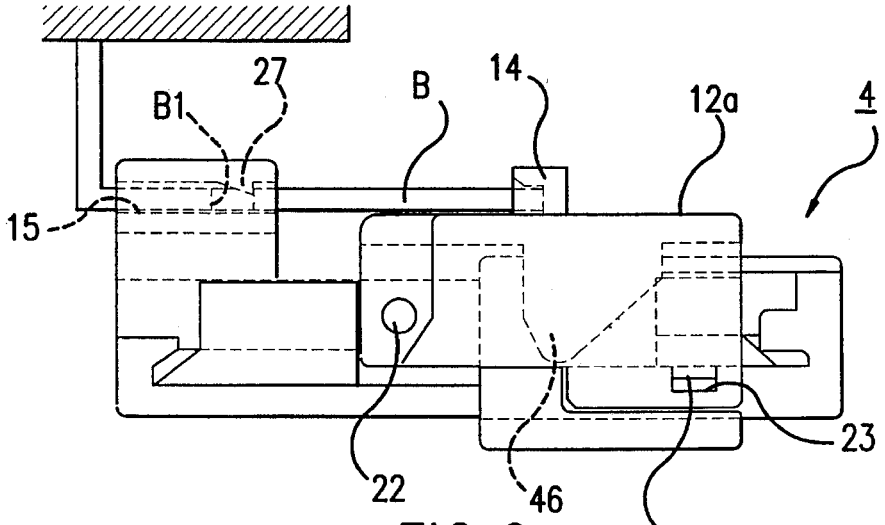
FIG. 6 is a side elevation showing the connector assembly attached to an attachment bracket in the fully-coupled state.

The lever 12 is generally in the shape of an inverted 'U' so as to cover the top surface of the hood 11, and comprises side surfaces 12*b* on either side of the top surface 12*a*. Additionally, holes 21, which couple with and are supported by spindles 22 projecting on the side surfaces of the male connector housing 1, are provided to the rear of the two side surfaces 12*b*, and these spindle holes 21 define a pivot axis and permit the lever 12 to turn from a position along the top surface of the hood 11, as shown in FIG. 4, to a separated position, as shown in FIG 3. Furthermore, engagement holes 23, which engage with the engagement projections 41 provided on the sides of the female connector housing 4 discussed hereinbelow, are provided to the front of the side surfaces 12*b*. Additionally, as shown in FIG. 5, the arrangement is such that when the engagement holes 23 are engaged with the engagement projections 41, the top surface 12*a* of the lever 12 is held in the position along the top surface 11*a* of the hood 11.

As shown in FIG. 3, a pushing piece 26, which fits into the in-fitting hole 25 of the hood 11 mentioned above, is formed projecting in the centre of the underside of the upper surface 12*a* of the lever 12. The bottom surface of this pushing piece 26 is formed in the shape of a mound having an inclined coupling surface 26*b* and an inclined disengagement surface 26*c*. The inclined coupling surface 26*b* is provided inclined to the rear from the apex 26*a* of the pushing piece 26, and the inclined disengagement surface 26*c* is provided inclined to the front from the apex 26*a*.

As shown in FIG. 3, to form the bracket attachment part 13, there is a sleeve-like bracket passage hole 15, extending upwards from the top surface to the rear of the male connector housing 1 and through which the attachment bracket B passes from the rear. Additionally a holding projection 27 which engages with the attachment hole B1 provided in the attachment bracket B is provided on the inside of this bracket passage hole 15.

Furthermore, a bracket stopper 14 is formed projecting in the centre of the top surface of the lever 12. As shown in FIG. 4, in the bracket stopper 14, the periphery of the upright stopper wall 14*a* is surrounded by a top wall 14*b* and left and right side walls 14*c*, and a guiding surface 14*d* is formed on the inside of the top wall 14*b*. Additionally, the arrangement is such that the front of the attachment bracket B passes inside the bracket passage hole 15, follows the top surface 12*a* of the lever 12, and comes into contact with the stopper wall 14*a*. Thus, the connector is arranged in such a way that it is attached by engaging with the attachment bracket B in two locations, namely the bracket attachment part 13 and the top wall 14*b*.

Meanwhile, as shown in FIG. 1, the female connector housing 4 is formed in an approximately rectangular form such that its front can fit into the hood 11, and engagement projections 41 for engagement with the above-mentioned engagement holes 23 are formed projecting on both side surfaces. Furthermore, female terminal receiving chambers 40, which couple with female terminals 5, are provided in parallel to the left and to the right inside the female connector housing 4. An upwardly directed flexible lance 43 is formed inside the female terminal receiving chamber 40 extending forwards from the top surface, and this is provided with a holding projection 43*a* which effects a first hold by engaging with a holding hole on the top surface of the respective female terminal 5.

A retainer insertion hole 44 receiving a retainer 45 effecting a second hold on the female terminal 5 is provided on a side surface of the female connector housing 4 running through to this female terminal receiving chamber 40. The retainer 45 has a raised track 45*a* projecting from the top surface thereof, and which engages with a recessed part 5*b* provided in the bottom surface of the female terminal 5, thereby effecting a second hold on the female terminal 2.

As shown in FIGS. 1 and 3, an in-fitting channel 47 is provided in the top surface of the female connector housing 4, cut away across the central region from the front, arranged in such a way that the above-mentioned pushing piece 26 can be fitted therein. A contact piece 46 lying across the in-fitting channel 47 is integrally formed at the front of the in-fitting channel 47. If the lever member 12 is pushed down when the female connector housing has been semi-coupled in the hood 1 as shown in FIG. 3, then the inclined coupling surface 26*b* of the pushing member 26 comes into contact with the contact piece 46 thereby advancing the female connector housing 4 in the coupling direction.

The action of this embodiment is now explained. The action will be described for cases in which the connector is attached to its attachment bracket B in the fully coupled state, the semi-coupled state, and in an improperly coupled state.

Figure 8:
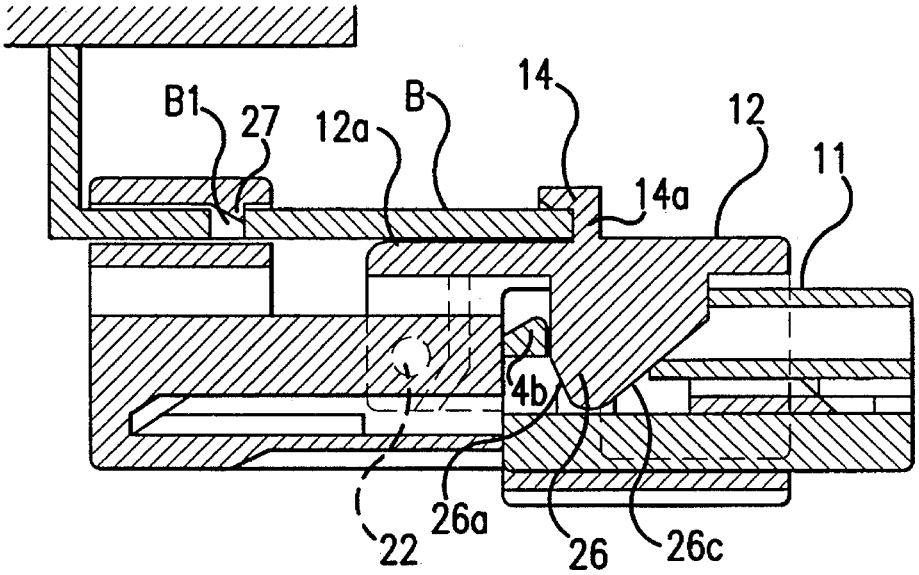
FIG. 8 is a cross section showing the connector assembly attached to the attachment bracket in the fully-coupled state.

The female connector housing 4 is inserted into the hood 11 of the male connector housing 1 to produce the semi-coupled state shown in FIG. 2, in which the front of the tab 2*a* of the male terminal 2 touches the female terminal 5. If the lever 12 is turned in this state, then, as shown in FIG. 3, the pushing piece 26 progresses into the in-fitting hole 25 and the in-fitting channel 47 formed in the hood 11 and the female connector housing 4 respectively, thereby coming into contact with the contact piece 46. At this time, the inclined coupling surface 26*b* of the pushing piece 26 comes into contact with the contact piece 46. Consequently if the lever 12 is turned further so that it is turned to the position in which it lies along the outside surface of the hood 11, then the inclined coupling surface 26*b* pushes the contact piece 46 and the female connector housing 4 is urged in the coupling direction to produce the fully coupled state shown in FIG. 4. In this way, the male and the female terminals 2 and 5 are fully coupled together. Furthermore, the engagement holes 23 provided on both side surfaces of the lever 12 engage with the engagement projections 41 provided on the side surfaces of the female connector housing 4 and the lever 12 is locked. Having produced the fully coupled state in this way, if the attachment bracket B is inserted into the bracket passage hole 15, then, as shown in FIG. 8, the end of the attachment bracket B follows over the top surface 12*a* and it is inserted until its front surface comes into contact with the stopper wall 14*a*, and at the same time the holding projection 27 is engaged by the attachment hole B1 of the attachment bracket B whereby the connector is fixed against movement.

Figure 7:
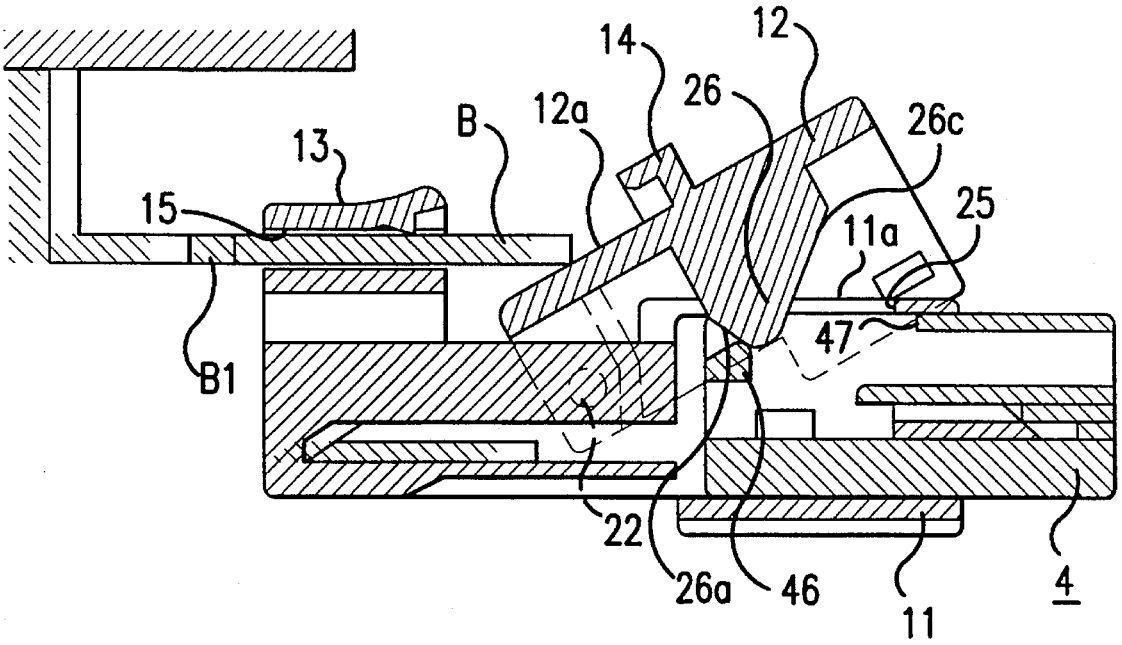
FIG. 7 is a cross section illustrating connector assembly being attached to the attachment bracket in a semi-coupled state.

If an attempt is made to attach the connector to the attachment bracket B in the semi-coupled state without having turned the lever 12, then, as shown in FIG. 7, the front of the attachment bracket B passes through the inside of the bracket insertion hole 15, and it then comes into contact with the top surface 12*a* of the lever 12 which is inclined. The inclined top surface 12*a* is pushed down by the attachment bracket B, and the lever member 12 pivots to lie along the outer surface of the hood 11. The front of the attachment bracket B is inserted up to the point at which it comes into contact with the stopper wall 14*a*, the engagement projection 27 engages with the attachment hole B1 of the attachment bracket B whereby the connector is fixed, and the fully coupled state shown in FIG. 8 is produced. Thus, even if an operator forgets to turn the lever 12, the connector is put into the fully coupled state when it is attached to the attachment bracket B and there are no instances in which it can be attached to the attachment bracket B in the semi-coupled state.

Figure 9:
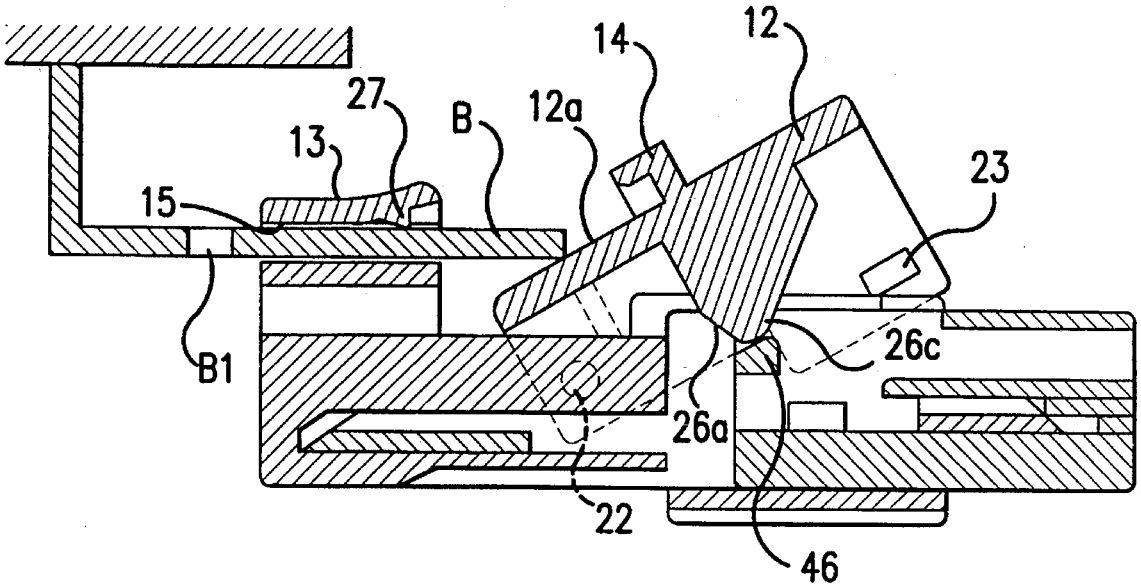
FIG. 9 is a cross section illustrating connector assembly being attached to the attachment bracket in an improperly coupled state.
Figure 10:
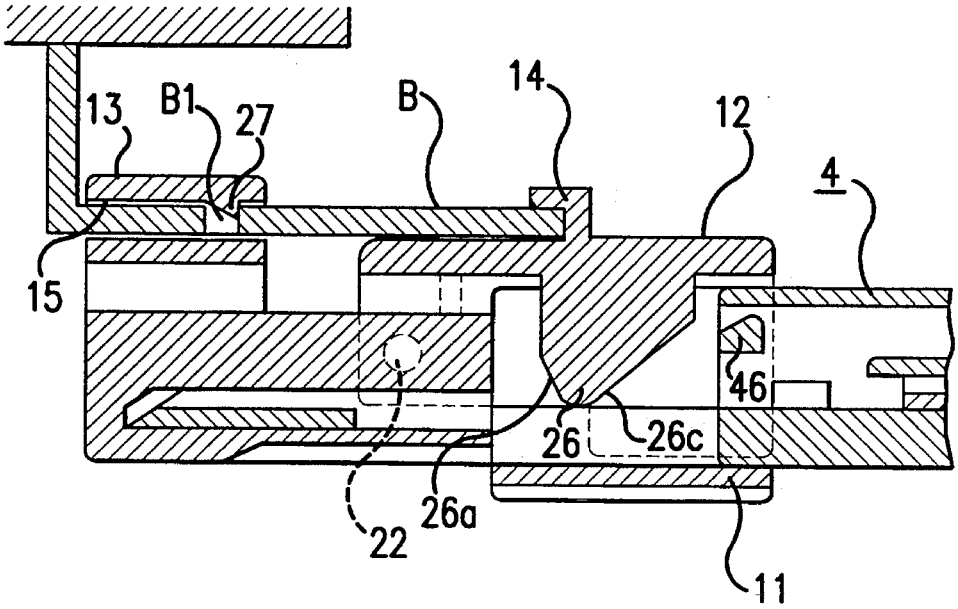
FIG. 10 is a cross section of the connector assembly attached to the attachment bracket in the improperly coupled state.
Figure 7:
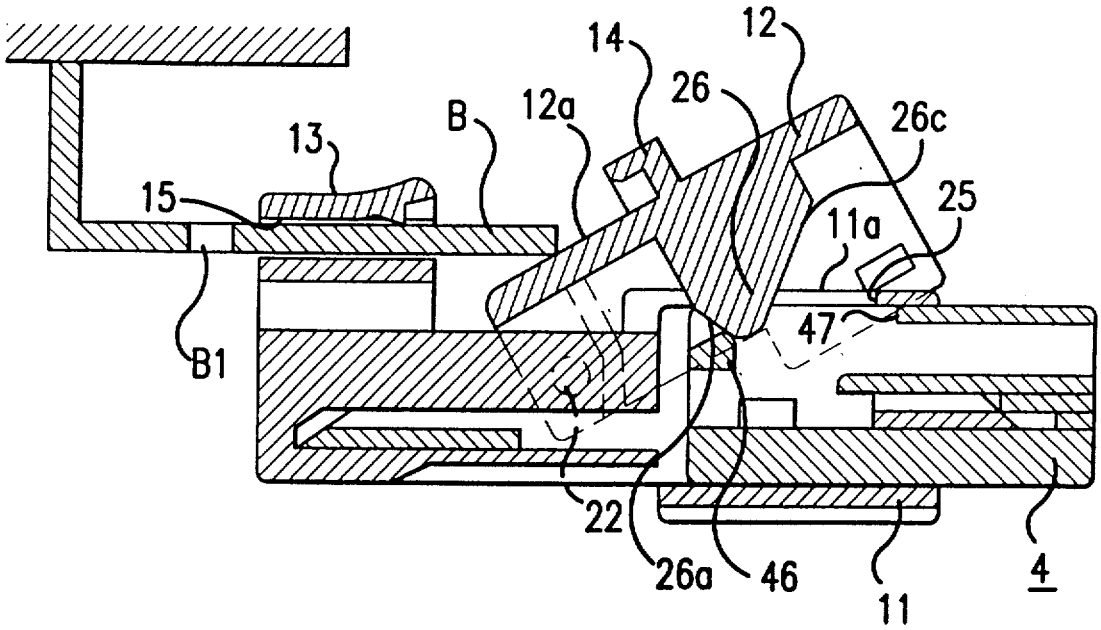
Figure 8:
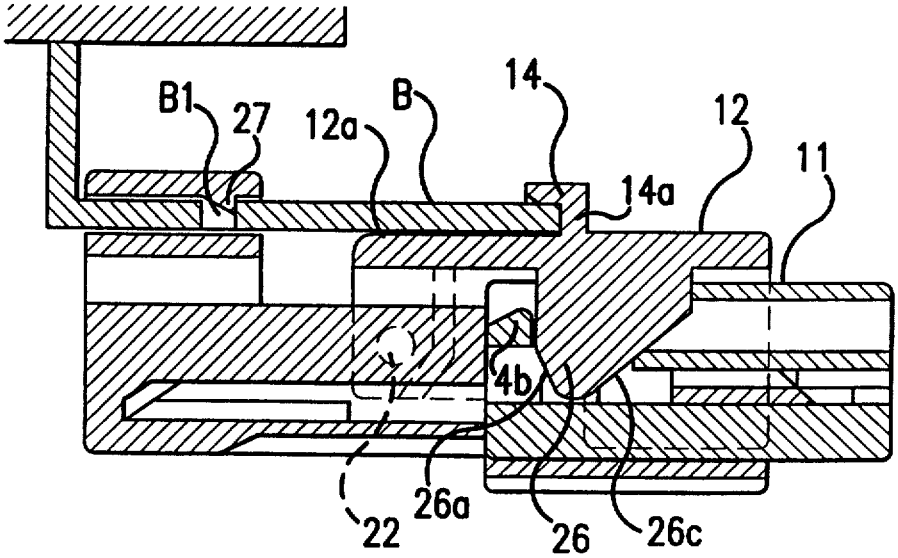

If, as shown in FIG. 9, an attempt is made to attach the connector to the attachment bracket B in the improperly coupled state in which the female connector housing 4 is only slightly inserted into the hood 11, then the front of the attachment bracket B pushes down the top surface 12*a* of the inclined lever 12, and the lever 12 is turned to the position in which it lies along the outer surface of the hood 11. However, in the improperly coupled state, the inclined disengagement surface 26*c* of the pushing piece 26 comes into contact with the contact piece 46. Consequently, as the lever 12 is turned, the inclined disengagement surface 26*c* pushes the contact piece 46, thereby producing the disengaged state shown in FIG. 10 in which the female connector housing 4 is pushed out in the disengaging direction. Because the fact that the female connector housing 4 has been pushed out of the hood 11 can be satisfactorily checked visually, the operator can easily discern that the connector is not in the fully coupled state and can repeat the assembly operation.

Thus, with the connector of this embodiment, even if the connector is attached to the attachment bracket B having omitted to put it in the fully coupled state, it will be corrected and put into the fully coupled state if it was in the semi-coupled state, or the female connector housing 4 will be pushed out from the male connector housing 1 if it was in an improperly coupled state, and the connector is therefore prevented from being attached to the attachment bracket B in a semi-coupled state or an improperly coupled state.

Furthermore, because the attachment bracket B need only be inserted until the stopper wall 14*a* comes into contact with the front of the attachment bracket B when the connector is attached to the attachment bracket B, attachment of the connector onto the attachment bracket B can be easily performed.

I claim:

1. An electrical connector assembly for attachment to a support member (B) provided on an object to which the connector assembly is to be fixed in use, the connector assembly comprising a male connector and a female connector each having a free end for mutual engagement along an assembly axis, one of said connectors having a lever pivoted thereon and the other of said connectors having a lever receiving aperture and a lever abutment, said lever being engageable in said aperture with said lever abutment and being pivotable around a pivot axis in use from an open position to a closed position flush with the outer surface of said one connector thereby urging the male and female connector into a fully coupled state, wherein said one connector includes a support receiving member for engagement with said support member (B), the support receiving member being adapted to ensure movement of said lever to said closed position on full engagement with said support member (B).

2. An electrical connector assembly according to claim 1 wherein said support receiving member includes an attachment aperture adapted to receive said support member.

3. An electrical connector assembly according to claim 2 wherein said lever includes an attachment abutment.

4. An electrical connector assembly according to claim 3 wherein said attachment abutment and said attachment aperture are aligned in the direction of engagement with said support member-(B).

5. An electrical connector assembly according to claim 4 wherein said attachment abutment and said attachment aperture are aligned with said assembly axis.

6. An electrical connector assembly according to claim 1 wherein the pivot axis of said lever is perpendicular to said assembly axis.

7. An electrical connector assembly according to claim 6 wherein a free end of said lever is closer to the free end of said one connector than said pivot axis.

8. An electrical connector assembly according to claim 7 wherein said lever abutment is adjacent the free end of said other connector.

9. An electrical connector assembly according to claim 1 wherein said lever comprises a projection having a first surface facing away from the free end of said one connector, said first surface being for engagement with a first engagement surface of said lever abutment which faces away from the free end of said other connector.

10. An electrical connector assembly according to claim 9 wherein said lever includes a second surface opposite said first surface and said lever abutment includes a second engagement surface opposite said first engagement surface, said second surface being engageable with said second engagement surface, said first and second surfaces meeting at an apex of said projection, and said first and second engagement surfaces meeting at an apex facing said lever.

11. An electrical connector assembly according to claim 9 wherein said projection is plate like and extends perpendicular to said pivot axis and to said assembly axis.

12. An electrical connector assembly according to claim 11 wherein said lever receiving aperture is a slot.

13. An electrical connector assembly according to claim 10 wherein said projection is plate like and extends perpendicular to said pivot axis and to said assembly axis.

14. An electrical connector assembly according to claim 1 wherein said lever receiving aperture is a slot.

15. An electrical connector assembly according to claim 1 wherein said male connector is provided with a hood to receive the female connector, said lever being pivoted on said hood.

16. An electrical connector assembly according to claim 1 wherein said lever includes latching means for engagement with said male connector when in the fully coupled state.

17. An electrical connector assembly according to claim 1 wherein said support member being adapted for attachment to an object to which the connector assembly is to be fixed in use.

18. An electrical connector assembly according to claim 16 wherein said support member and said assembly include respective male and female latch members adapted to be latched on full engagement of the assembly and support member.

* * * * *

UNITED STATES PATENT AND TRADEMARK OFFICE

CERTIFICATE OF CORRECTION

PATENT NO. : 5,556,302
DATED : Sep. 17, 1996
INVENTOR(S) : Osamu Taniuchi, et al It is certified that error appears in the above-identified patent and that said Letters Patent is hereby corrected as shown below:

The title page, should be deleted to be replaced with the attached title page.

The drawing sheet consisting of Fig. 7, should be deleted to be replaced with the drawing sheet, consisting of Fig. 7, as shown on the attached page.

United States Patent [19]

Taniuchi et al.

[11] Patent Number: 5,556,302

[45] Date of Patent: Sep. 17, 1996

[54] ELECTRICAL CONNECTOR

[75] Inventors: Osamu Taniuchi; Hisashi Konoya; Youichi Nankoh, all of Yokkaichi, Japan

[73] Assignee: Sumitomo Wiring Systems, Ltd., Japan

[21] Appl. No.: 386,910

[22] Filed: Feb. 8, 1995

[30] Foreign Application Priority Data

Feb. 8, 1994 [JP] Japan ..... 6-036443

[51] Int. Cl.[6] ..... H01R 13/60

[52] U.S. Cl. ..... 439/533; 439/372; 439/310

[58] Field of Search ..... 439/345, 350, 439/372, 352, 310, 533

[56] References Cited

U.S. PATENT DOCUMENTS

| | | | |
|---|---|---|---|
| 4,884,978 | 12/1989 | Inaba et al. | 493/372 X |
| 4,892,490 | 1/1990 | Tsuchiya et al. | 439/533 |
| 4,938,710 | 7/1990 | Aihara et al. | 439/533 X |
| 5,376,017 | 12/1994 | Taniuchi et al. | 439/372 |

*Primary Examiner*—Khiem Nguyen

*Attorney, Agent, or Firm*—Banner & Allegretti, Ltd.

[57] ABSTRACT

An electrical connector assembly is provided which assumes a fully coupled state even if it was in a semi-coupled state prior to being attached to a support bracket (B). A lever has an inclined coupling surface which draws a semi-coupled female connector housing in the coupling direction, thereby ensuring a fully coupled state. A support bracket (B) cannot be fully inserted until the lever has moved the connectors from a semi-coupled to a fully coupled condition. If the connectors are improperly connected a second inclined surface of the lever decouples the connectors as the support bracket (B) is engaged.

18 Claims, 5 Drawing Sheets

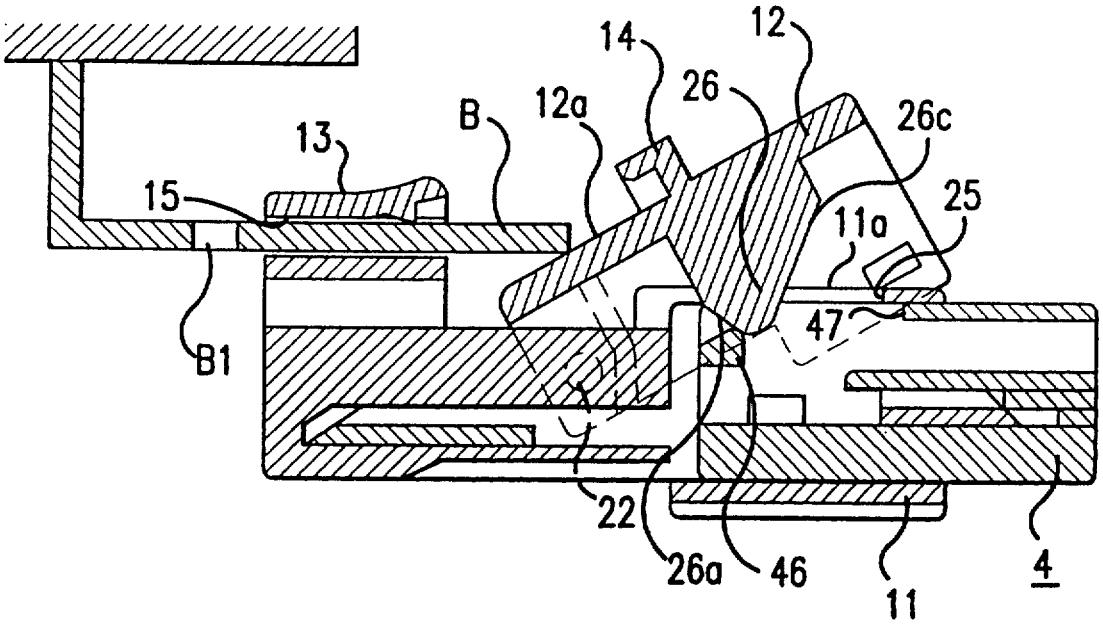

UNITED STATES PATENT AND TRADEMARK OFFICE

CERTIFICATE OF CORRECTION

PATENT NO. : 5,556,302

DATED : 09/17/96

INVENTOR(S) : Osamu Taniuchi et al.

It is certified that error appears in the above-identified patent and that said Letters Patent is hereby corrected as shown below:

Column 5, line 24, change "female terminal 2" to --female terminal 5--.

In the Claims:

Claim 1, line 13, change "connector" to --connectors--.

In the Drawings:

Sheet 4, Fig. 7, attached hereto, a portion of the cross-hatching lines have been inadvertently offset due to a draftsman's error.

Signed and Sealed this

Fourteenth Day of September, 1999

*Attest:*

Q. TODD DICKINSON

*Attesting Officer*

*Acting Commissioner of Patents and Trademarks*